US006410497B1

(12) United States Patent
Kappes et al.

(10) Patent No.: US 6,410,497 B1
(45) Date of Patent: Jun. 25, 2002

(54) ACTIVATORS FOR PER COMPOUNDS COMPRISING OXIME CARBONATES OR OXIME POLYMERS

(75) Inventors: Elisabeth Kappes, Limburgerhof; Thomas Wehlage, Speyer; Alfred Oftring, Bad Dürkheim; Dieter Boeckh, Limburgerhof, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/355,335

(22) PCT Filed: Feb. 3, 1998

(86) PCT No.: PCT/EP98/00574

§ 371 (c)(1),
(2), (4) Date: Aug. 4, 1999

(87) PCT Pub. No.: WO98/33878

PCT Pub. Date: Aug. 6, 1998

(30) Foreign Application Priority Data

Feb. 4, 1997 (DE) ..... 197 04 143

(51) Int. Cl.[7] ..... C11D 3/395

(52) U.S. Cl. ..... 510/376; 510/276; 510/286; 510/302; 510/311; 510/312; 510/313; 510/314; 510/367

(58) Field of Search ..... 510/220, 226, 510/233, 276, 286, 300, 302, 305, 312, 314, 313, 367, 376

(56) References Cited

U.S. PATENT DOCUMENTS 4,957,647 A * 9/1990 Zielske ..... 252/186.38
5,002,691 A * 3/1991 Bolkan et al. ..... 252/186.25
5,458,801 A * 10/1995 Oyashiki et al. ..... 252/186.25

FOREIGN PATENT DOCUMENTS

EP 0 267 046 A2 5/1988
EP 267046 * 5/1988

* cited by examiner

*Primary Examiner*—Charles Boyer
(74) *Attorney, Agent, or Firm*—Oblon, Spivak, McClelland, Maier & Neustadt, P.C.

(57) ABSTRACT

Inorganic per compounds may be activated with oxime carbonates of the formula (I), A—O—CO—OR$^3$, a hydroximide ester of formula (II):

(II)

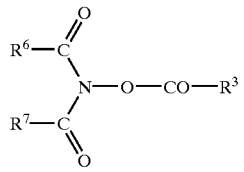

or polymeric hydroximide esters.

19 Claims, No Drawings

ACTIVATORS FOR PER COMPOUNDS COMPRISING OXIME CARBONATES OR OXIME POLYMERS

The invention relates to the use of carbonates, such as oxime carbonates and hydroxyimide carbonates, hydroxyimide esters and polymers thereof, as activators for inorganic per compounds, and to detergent formulations comprising them.

The use of particular hydroxyimide esters as bleach activators is known. EP-A-0 267 046 describes bleach compositions which comprise peracid precursors. Compounds cited include N-hydroxyimides, for example N-hydroxysuccinimide, N-hydroxyphthalimide, N-hydroxyglutarimide, N-hydroxynaphthalimide, N-hydroxymaleimide, N-hydroxydiacetylimide and N-hydroxydipropionylimide. These N-hydroxyimides are used in the form of esters with carboxylic acids, especially with octanoic acid. Use is also made of oxime esters which are formed from oximes of aldehydes or ketones with carboxylic acids, especially octanoic acid. Of these, preferred oximes are acetone oxime and methyl ethyl ketoxime.

It is an object of the present invention to provide further activators for inorganic per compounds which have an improved action especially in the case of hydrophobic bleaching.

We have found that this object is achieved by the use of carbonates of the formula (I)

$$A—O—CO—OR^3 \quad (I)$$

where

A is a radical (Ia)

$$R^1R^2C{=}N— \quad (Ia)$$

or A is a radical (Ib)

(Ib)

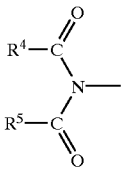

where $R^1$, $R^2$, $R^3$, $R^4$ and $R^5$ independently are straight-chain or branched $C_{1-30}$-alkyl, $C_{2-30}$-alkenyl, $C_{5-18}$-cycloalkyl, $C_{7-18}$-aralkyl or $C_{6-18}$-aryl or -heteroaryl, it being possible for aliphatic radicals to be functionalized additionally by 1 to 5 hydroxyl, $C_{1-4}$-alkoxy, amino, $C_{1-4}$-alkylamino, di-$C_{1-4}$-alkylamino, nitro, cyano, carboxyl, sulfo, carboxy-$_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and, if A is a radical (Ia), $R^3$ is not a vinyl which can be substituted by a carboxylic, sulfonic or phosphonic acid group or an alkali metal salt or ammonium salt thereof and is not a vinyloxy radical $—O—CR^1{=}CHR^2$ in which $R^1$ and $R^2$ are as defined above, and $R^3$ can be a radical (Ib) if A is a radical (Ib), especially if $R^4$ and $R^5$ together form a 1,2-phenylene ring (phthalimide derivative) or 1,2-ethylene ring (succinimide derivative), and $R^4$ and $R^5$, furthermore, can together form a 1,2-, 1,3-, 1,4-, 1,5- or 1,6-alkylene group of 2 to 30 C atoms, which can be substituted like the above alkylene groups, or $R^4$ and $R^5$ together form a 5-, 6-, 7-, 8- or 9-membered carbon ring which is attached to the carbonyl groups by way of 2 adjacent C atoms, where one or more double bonds can be present in the ring or the ring can be aromatically unsaturated and where one or more C atoms in the ring can be replaced by heteroatoms, and 2 C atoms in the ring can be attached via a heteroatom or a $C_{1-3}$-alkylene or $C_{2-3}$-alkenylene radical, or $R^4$ and $R^5$ can form the above carbon ring from 2 carbonate molecules together, which ring is attached to the carbonyl groups of the two imide structures by way of in each case two adjacent C atoms (see for example the tricyclic diimide structures of the formula VI below), or hydroxyimide esters of the formula (II)

(II)

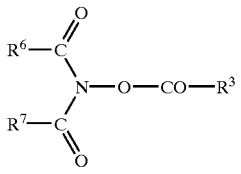

where $R^3$ is as defined above and $R^6$ and $R^7$ together form a 5-, 6-, 7-, 8- or 9-membered carbon ring which is attached to the carbonyl groups via two adjacent C atoms, where one or more double bonds can be present in the ring, one or more ring positions can be replaced by heteroatoms, and 2 C atoms in the ring can be connected via a heteroatom and a $C_{1-3}$-alkylene or $C_{2-3}$-alkenylene radical which is attached to the carbonyl groups of the two imide structures by in each case 2 adjacent C atoms, or $R^6$ and $R^7$ can form the above carbon ring from 2 hydroxyimide ester molecules together, which ring is attached to the carbonyl groups of the two imide structures via in each case two adjacent C atoms (see for example the tricyclic diimide structures of the formula VI below), or polymers which can comprise $C_{2-8}$, olefin comonomer units and comprise base units of the formulae (III), (IV) and/or (V)

(III)

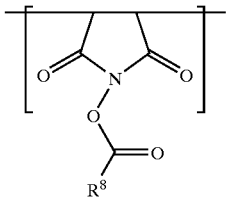

(IV)

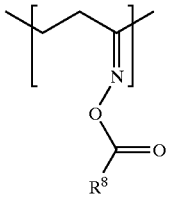

(V)

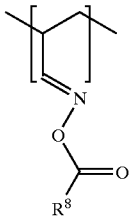

where $R^8$ is a radical $R^3$ or —$OR^3$ with the abovementioned definition as activators for inorganic per compounds.

The activators according to the invention can be used in detergents, cleaning products, bleaches and disinfectants, for example as cold bleach activators.

According to one embodiment of the invention the compounds are oxime carbonates, if A is a radical (Ia) $R^1R^2C{=}N$—. In this case $R^1$ and $R^2$, in addition to hydrogen, are, for example, linear or branched $C_{1-30}$-alkyls, such as methyl, ethyl, n-propyl, isopropyl, n-butyl, isobutyl, sec-butyl, tert-butyl, n-pentyl, isopentyl, sec-pentyl, tert-pentyl, neopentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl or n-eicosyl. Preferred alkyls are $C_{1-12}$-alkyls, especially $C_{1-4}$-alkyls; in particular, $R^1$ and $R^2$ are ethyl groups.

The radicals $R^1$ and $R^2$ can also be linear or branched $C_{2-30}$-alkenyls, such as vinyl, allyl or 2-methylprop-2-enyl, or radicals derived from oleic, linoleic or linolenic acid. Preference is given to $C_{2-6}$-alkenyl and to $C_{6-22}$-alkenyl radicals.

It is also possible to use $C_{5-18}$-cycloalkyl radicals, preferably $C_{5-10}$-cycloalkyl radicals, such as cyclopentyl, cyclohexyl, 2-, 3- or 4-methylcyclohexyl, 2,3-, 2,4-, 2,5- or 2,6-dimethylcyclohexyl, cycloheptyl or cyclooctyl.

Other radicals that can be used are $C_{7-18}$-aralkyl radicals, preferably $C_{7-12}$-aralkyl radicals, especially alkyl-substituted phenyl radicals such as benzyl, 2-, 3- or 4-methylbenzyl, 2-phenylethyl, 3-phenylpropyl, 4-phenylbutyl, 2-, 3- or 4-ethylbenzyl, 3- or 4-isopropylbenzyl or 3- or 4-butylbenzyl.

Examples of suitable $C_{6-18}$-aryl groups are phenyl, 2-, 3- or 4-biphenylyl, alpha- or beta-naphthyl, 2-, 3- or 4-methylphenyl, 2-, 3- or 4-ethylphenyl, 3- or 4-isopropylphenyl, 3- or 4-butylphenyl or 3- or 4-(2'-ethylhexyl)phenyl. Of these, preference is given to $C_{6-14}$-aryl radicals, especially phenyls and alkyl-substituted phenyls.

$C_{6-18}$-heteroaryl radicals are preferably 5- or 6-membered $C_{6-12}$-heteroaryl radicals having one or two heteroatoms from the group consisting of nitrogen, oxygen and sulfur. Examples of suitable heterocycles are pyridine, furan, thiophene, pyrrole, imidazole, pyrazole, thiazole, pyrazine and pyrimidine. These radicals can be attached by any one of the ring carbons. Furthermore, the ring structures can be substituted at the carbons which have free valences, preferably by $C_{1-4}$-alkyl radicals such as the abovementioned methyl, ethyl, propyl and butyl radicals.

Examples of aliphatic radicals interrupted by oxygen or amino groups, especially NH or $N(CH_3)$ groups, that can be employed are methylethylaminoethyl, dimethylaminomethyl, methoxymethyl, methoxyethyl, ethoxyethyl, hydroxyethyl, reacted with 1 to 8 ethylene oxide units, methoxybutyl, methoxypropyl, 2-methoxy-l-methylethyl and 2-hydroxy-1-methylethyl, reacted with 1 to 5 propylene oxide units.

$R^1$ and $R^2$ can together preferably form a $C_{3-12}$-alkylene radical. Examples are propylene radicals which are substituted in position 1, 2 or 3 by methyl, ethyl, propyl or butyl groups, butylene radicals which can be substituted in positions 1, 2, 1,2, 1,3 or 1,4 by methyl, ethyl, propyl or butyl groups, pentylene radicals, which can be substituted in positions 1, 2, 3, 1,5, 1,3, 2,4 or 3,3 by methyl groups or in one of the positions by ethyl, propyl, butyl, n-hexylene, n-heptylene or n-octylene. In this context, the alkylene radicals can have the interruptions or functionalizations described.

The aldoxime or ketoxime groups $R^1RC{=}$ in these compounds can be derived from known aldehydes or ketones such as formaldehyde, acetaldehyde, propionaldehyde, benzaldehyde, vinylacetaldehyde, acetone, ethyl methyl ketone, diethyl ketone, acetophenone, vinylacetone, benzophenone, cyclopentanone, cyclohexanone or cycloheptanone.

The radicals $R^4$ and $R^5$ can together form a 1,2-, 1,3-, 1,4-, 1,5- or 1,6-alkylene group of 2 to 30 C atoms.

Preferred groups in this context are $C_{2-10}$-alkylene groups, such as ethylene, which can be substituted in positions 1 or 2 or 1 and 2 by methyl, ethyl, propyl or butyl radicals, or propylene, butylene, pentylene or hexylene, as described above. These radicals too can be functionalized or interrupted.

The radical $R^3$ is preferably a $C_{1-20}$-alkyl radical, particularly preferably a $C_{1-4}$-alkyl or $C_{7-15}$-alkyl radical, which can be straight-chain or branched. Preferred radicals are methyl and n-butyl radicals, and also radicals derived from industrial alcohols or alcohol mixtures, especially branched alcohols or alcohol mixtures. Examples of these are $C_{8/10}$ Lorol, iso-$C_{10}$ alcohol, $C_{9/11}$ oxo alcohol, $C_{11/13}$ oxo alcohol, 2-propylheptanol and 2-ethylhexanol. Preference is likewise given to aralkyl radicals, especially $C_{1-4}$-alkyl radicals substituted by a phenyl radical. Benzyl is a particularly preferred radical.

In the carbonates of the formula (I) in which the radical A is a radical (Ib) the radical $R^3$ can also preferably be a phenyl radical which can be unsubstituted or substituted by the substituents indicated.

$R^4$ and $R^5$ can together form a 5-, 6-, 7-, 8- or 9-membered carbon ring which is attached by two adjacent C atoms to the carbonyl groups. It can accordingly be a cyclopentyl, cyclohexyl, cycloheptyl, cyclooctyl or cyclononyl ring which is attached at 2 adjacent C atoms to the carbonyl groups in the radical (Ib). This ring can be substituted, as described above, or one or more of the C atoms in the ring can be replaced by heteroatoms. One example of such a compound is piperidine. Other known heterocyclic compounds may constitute this ring. The ring is preferably a 5- or 6-membered ring. The ring can contain one or more double bonds or can be aromatically unsaturated. It can preferably be a 6-membered ring which has a double bond and is connected in 4,5-position to the carbonyl groups. This is, accordingly, a cyclohexene ring. Likewise preferably, the ring is an aromatically unsaturated ring, especially a 6-membered ring. In this case the compounds are phthalic acid derivatives. Preference is given to diterephthalic hydroxyimide carbonates, which are obtainable by reacting terephthalic hydroxyimide with phosgene. The aromatic rings can also carry substituents. Furthermore, 2 C atoms in the ring can be attached via a heteroatom or a $C_{1-3}$-alkylene radical or $C_{2-3}$-alkenylene radical. In this case the radical is, consequently, a bicyclic radical. Bridging is preferably effected with oxygen as heteroatom or with a $C_{1-2}$-alkylene radical, especially methylene. In this case, preferably none of the rings has less than 5 ring atoms. With particular preference, in a 6-membered carbon ring the two ring carbons are attached which are adjacent to the C atoms via which the ring is attached to the carbonyl groups of the radical (Ib). In this case the ring is preferably a cyclohexene ring in which the carbons adjacent to the C atoms attached to the carbonyl groups are bridged via an oxygen atom or a methylene group. In this case the double bond in the cyclohexene ring is between the two remaining carbons.

$R^4$ and $R^5$ from two carbonate molecules can also together form the above carbon ring, which is thus attached to four carbonyl groups. In this case $R^3$ is as defined above and is preferably a phenyl radical. Examples of suitable cyclic radicals are given by the following formulae VI

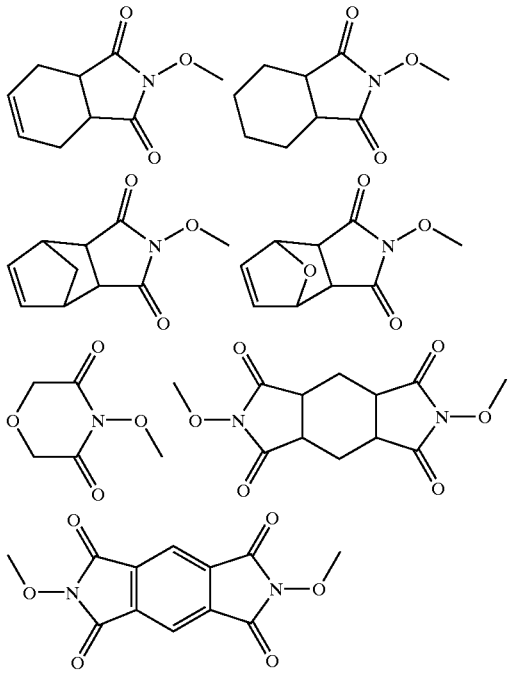

Preferably, the radicals $R^1$ and $R^2$ independently are $C_{1-4}$-alkyl radicals, $R^3$ is a $C_{1-10}$-alkyl, phenyl or benzyl radical and $R^4$ and $R^5$ together form a 1,2-phenylene or 4,5-cyclohexenylene radical.

According to one embodiment of the invention the activators for inorganic per compounds are hydroxyimide esters of the formula (II)

(II)

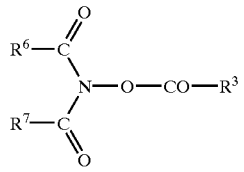

where $R^3$ is as defined above. $R^6$ and $R^7$ here form a 5-, 6-, 7-, 8- or 9-membered carbon ring which, as above for the compounds of the formula (I) with the radical (Ib) as radical A, is attached to the carbonyl groups via two adjacent C atoms. The preferred radicals $R^6$ and $R^7$ are the abovementioned cyclic radicals from $R^4$ and $R^5$ which are attached to the carbonyl groups via 2 adjacent C atoms.

It is also possible to use polymers which have base units of the formula (III), (IV) and (V).

(III)

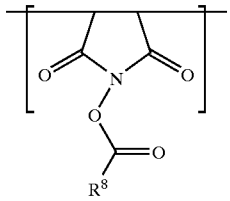

(IV)

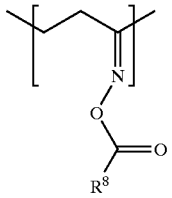

(V)

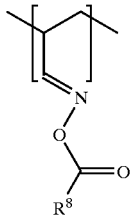

where $R^8$ is a radical $R^3$ or —$OR^3$ with the abovementioned definition. Each molecule of these polymers comprises at least two monomer units as indicated above and can comprise $C_{2-8}$ olefin comonomer units. The polymers can therefore be homopolymers formed from the stated base units, copolymers of the stated base units with one another, and also copolymers of the stated base units with, preferably, ethene, propene, n-butene, isobutene or pentenes. The polymers comprising base units of the formula (III) can be prepared on the basis of maleic anhydride (co)polymers, for example a maleic anhydride-isobutene copolymer. The number of base units of the formula (III), (IV) and (V) is at least 2, preferably from 2 to 5000, especially from 10 to 1000. The number of olefinic comonomer units here is from 0 to 50,000, preferably from 10 to 10,000 and, in particular, from 100 to 1000.

The base units (IV) and (V) can be based on polyketones, for example oligo(meth)acrolein, or an ethylene-CO copolymer.

Bleach activators which are particularly preferred in accordance with the invention are N-(2-propylheptyloxycarbonyl)oxyphthalimide, N-(vinyloxycarbonyl)oxycyclohex-4-ene-1-dicarboximide, O-(methyloxycarbonyl)acetone oxime, O-(benzyloxycarbonyl) acetone oxime and O-(n-butyloxycarbonyl)acetone oxime.

The bleach activators according to the invention can be employed as activators for inorganic per compounds, preferably in applications where a particular increase in the oxidation effect of the inorganic per compounds at low temperatures is critical, for example in connection with the bleaching of textiles, hair or hard surfaces, in the oxidation of organic or inorganic intermediates, and in disinfection. In this context the activators are of particular advantage in connection with the bleaching of hydrophobic soiling.

In general the bleach activators according to the invention are solid compounds which lend themselves well to stable incorporation into pulverulent or granular detergent, bleach or cleaning formulations.

The conditions when the compounds are employed are preferably those under which compounds containing active oxygen, such as hydrogen peroxide, and the activators react with one another, the intention being that more strongly oxidizing follow-on products should be obtained. Examples of such conditions are those of an aqueous alkaline solution which comprises both reactants. Depending on the intended use, these conditions can be varied over a wide range. In addition to pure aqueous solutions it is also possible to employ mixtures of water and appropriate organic solvents, for use for example in disinfection or in connection with the oxidation of intermediates. The pH of the reaction medium can be varied within broad limits from the acidic range (pH 4) to a highly alkaline range (pH 13). The pH is preferably from 8 to 11. The activators are preferably used together with a sodium perborate or with sodium carbonate perhydrate, whose solutions already have pH values within the range stated above. Examples of other suitable per compounds are phosphate perhydrates and urea perhydrate. Occasionally it may be judicious to shift the pH of the medium again, especially in the acidic range, by means of appropriate additives after the activation reaction.

The amounts of per compounds employed are generally chosen such that there is from 10 to 10,000 ppm of active oxygen in the solutions, preferably from 50 to 5000 ppm of active oxygen. The amount of activator used in this context depends on the intended application. Depending on the desired degree of activation, from 0.03 to 1.0 mol, preferably from 0.1 to 0.5 mol, of activator is used per mole of inorganic per compound.

For activation, the activators according to the invention can be employed in pure form or—if judicious, in order for example to increase the shelf life—can be employed in special formulations, such as tablets, granules or in the form of prills (enveloped with fine particles). They are preferably in forms produced by agglomeration granulation. For metering by machine, the activators should be in dissolved or disperse form.

The activators are preferably used in prepackaged compositions as a mixture with the per compounds which are to be activated and with or without further components required for the bleaching, oxidation or cleaning process. In this context the activators according to the invention can also be used in combination with known activators. The text below lists further constituents of novel detergents and bleaches, bleach additives or dishwashing compositions, and disinfectants.

The bleaches that can be used have already been described above.

BLEACH CATALYSTS

The bleach activators employed in accordance with the invention can be employed together with appropriate bleach catalysts. Examples of such catalysts are quaternized imines and sulfonimines, as are described, for example, in U.S. Pat. No. 5,360,568, U.S. Pat. No. 5,360,569 and EP-A-0 453 003, and also manganese complexes, as are described, for example, in WO-A 94/21777. Other metal-containing bleach catalysts that can be used are described in EP-A-0 458 397, EP-A-0 458 398, EP-A-0 549 272. Also suitable are secondary amines as described in the German patent application having the file reference 19625908.8.

Bleach activators which according to one embodiment of the invention can be employed in the compositions together with the activators according to the invention are, for example, compounds from the following classes of substance:

Polyacylated sugars or sugar derivatives with $C_{1-10}$-acyl radicals, preferably acetyl, propionyl, octanoyl, nonanoyl or benzoyl radicals, especially acetyl radicals, can be used as bleach activators. Sugars or sugar derivatives which can be used are mono- or disaccharides and their reduced or oxidizes derivatives, preferably glucose, mannose, fructose, sucrose, xylose or lactose. Examples of particularly suitable bleach activators of this class of substance are pentaacetylglucose, xylose tetraacetate, 1-benzoyl-2,3,4,6-tetraacetylglucose and 1-octanoyl-2,3,4,6-tetraacetylglucose.

A further class of substance which can be used comprises the acyloxybenzenesulfonic acids and their alkali metal and alkaline earth metal salts, the use being possible of $C_{1-4}$-acyl radicals. Preference is given to acetyl, propionyl, octanoyl, nonanoyl and benzoyl radicals, especially acetyl and nonanoyl radicals. Particularly suitable bleach activators from this class of substance are acetyloxybenzenesulfonic acid, benzoyloxybenzenesulfonic acid and nonanoyloxybenzenesulfonic acid (NOBS) and isononanoyloxybenzenesulfonic acid (isoNOBS). They are preferably employed in the form of their sodium salts.

It is also possible to use O-acyl oxime esters, for example O-acetylacetone oxime, O-benzoylacetone oxime, bis(propylimino) carbonate, bis(cyclohexylimino) carbonate. Examples of acylated oximes that can be used in accordance with the invention are described in EP-A 0 028 432. Oxime esters that can be used in accordance with the invention are described, for example, in EP-A-0 267 046.

It is likewise possible to use N-acylcaprolactams, for example N-acetylcaprolactam, N-benzoylcaprolactam, N-octanoylcaprolactam and carbonylbiscaprolactam.

Further possibilities for use are

- N-diacylated and N,N'-tetraacylated amines, for example N,N,N',N'-tetraacetylmethylenediamine and -ethylenediamine (TAED), N,N-diacetylaniline, N,N-diacetyl-p-toluidine or 1,3-diacylated hydantoins, such as 1,3-diacetyl-5,5-dimethylhydantoin;
- N-alkyl-N-sulfonylcarboxamides, for example N-methyl-N-mesylacetamide or N-methyl-N-mesylbenzamide;
- N-acylated cyclic hydrazides, acylated triazoles or urazoles, for example monoacetyl-maleic hydrazide;
- O,N,N-trisubstituted hydroxylamines, for example O-benzoyl-N,N-succinylhydroxylamine, O-acetyl-N,N-succinylhydroxylamine or O,N,N-triacetylhydroxylamine;
- N,N'-diacyl-sulfurylamides, for example N,N'-dimethyl-N,N'-diacetylsulfurylamide or N,N'-diethyl-N,N'-dipropionylsulfurylamide;

triacyl cyanurates, for example triacetyl cyanurate or tribenzoylcyanurate;

carboxylic anhydrides, for example benzoic anhydride, m-chlorobenzoic anhydride or phthalic anhydride;

1,3-diacyl-4,5-diacyloxyimidazolines, for example 1,3-diacetyl-4,5-diacetoxyimidazoline;

tetraacetylglycoluril and tetrapropionylglycoluril;

diacylated 2,5-diketopiperazines, for example 1,4-diacetyl-2,5-diketopiperazine;

acylation products of propylenediurea and 2,2-dimethylpropylenediurea, for example tetraacetylpropylenediurea;

α-acyloxy-polyacyl-malonamides, for example α-acetoxy-N,N'-diacetylmalonamide; and diacyl-dioxohexahydro-1,3,5-triazines, for example 1,5-diacetyl-2,4-dioxohexahydro-1,3,5-triazine.

Similarly it is possible to use 2-alkyl- or 2-aryl-(4H)-3,1-benzoxazin-4-ones, as are described for example in EP-B1-0 332 294 and EP-B 0 502 013. In particular it is possible to use 2-phenyl-(4H)-3,1-benzoxazin-4-one and 2-methyl-(4H)-3,1-benzoxazin-4-one.

A further possibility for use comprises cationic nitrites as described, for example, in EP 303 520 and EP 458 396 A1. Examples of suitable cationic nitriles are the methosulfates or tosylates of trimethylammoniumacetonitrile, N,N-dimethyl-N-octylamoniumacetonitrile, 2-(trimethylammonium)propionitrile, 2-(trimethylammonium)-2-methylpropionitrile, N-methylpiperazinium-N,N'-diacetonitrile and N-methylmorpholiniumacetonitrile.

The bleach activators that can be used in accordance with the invention are preferably in the solid aggregate state at room temperature, since intensive contact of the bleach catalyst with the bleach activator prior to use can adversely affect the achievement of the optimum bleaching effect. Additional crystalline bleach activators that are particularly suitable in accordance with the invention are tetraacetylethylenediamine (TAED), NOBS, isoNOBS, carbonylbiscaprolactam, benzoylcaprolactam, bis(2-propylimino) carbonate, bis(cyclohexylimino) carbonate, O-benzoylacetone oxime and 2-phenyl-(4H)-3,1-benzoxazin-4-one, anthranil, phenylanthranil, N-octanoylcaprolactam (OCL) and N-methylpiperazinium-N,N'-diacetonitrile, and also liquid or poorly crystallizing bleach activators in a solid formulation.

BLEACH STABILIZERS

In accordance with one embodiment of the present invention the compositions that can be employed, for example, in detergents and cleaning products additionally comprise one or more bleach stabilizers. These are additives which are able to complex, bind or adsorb traces of heavy metal. Examples of additives with a bleach-stabilizing action that can be used in accordance with the invention are polyanionic compounds such as polyphosphates, polycarboxylates, polyhydroxypolycarboxylates, soluble silicates in the form of fully or partially neutralized alkali metal salts or alkaline earth metal salts, especially in the form of neutral Na or Mg salts, which are relatively weak bleach stabilizers. Strong bleach stabilizers which can be used in accordance with the invention are, for example, complexing agents such as ethylenediaminetetraacetate (EDTA), nitrilotriacetic acid (NTA), methylglycinediacetic acid (MGDA), β-alaninediacetic acid (ADA), ethylenediamine-N,N'-disuccinate (EDDS) and phosphonates such as ethylenediaminetetramethylenephosphonate, diethylenetriaminepentamethylenephosphonate or hydroxyethylidene-1,1-diphosphonic acid in the form of the acids or as fully or partially neutralized alkali metal salts. The complexing agents are preferably employed in the form of their Na salts.

The detergents according to the invention preferably include at least one bleach stabilizer, with particular preference at least one of the abovementioned strong bleach stabilizers.

In the field of textiles washing, bleaching and household cleaning and in the industrial sector the compositions described can, in accordance with one embodiment of the invention, comprise virtually any customary constituents of detergents, bleaches and cleaning products. In this way it is possible, for example, to construct textile detergents which are specifically suitable for textile treatment at low temperatures, as well as those which are suitable within a plurality of temperature ranges up to and including the traditional range of the boil wash.

Principle constituents of textile detergents, bleaches and cleaning products, in addition to the bleach composition consisting of bleach, bleach activator according to the invention and, if used, bleach catalysts and bleach stabilizers, are builders, ie. inorganic builders and/or organic cobuilders, and surfactants, especially anionic and/or nonionic surfactants. In addition it is also possible for other customary auxiliaries and adjuncts to be present in these compositions if judicious, such as extenders, complexing agents, phosphonates, colorants, corrosion inhibitors, graying inhibitors (antiredeposition agents) and/or soil release polymers, color transfer inhibitors, bleach catalysts, peroxide stabilizers, electrolytes, fluorescent whiteners, enzymes, perfume oils, foam regulators and activating substances.

INORGANIC BUILDERS

Suitable inorganic builder substances are all customary inorganic builders, such as aluminosilicates, silicates, carbonates and phosphates.

Examples of suitable inorganic builders. are aluminosilicates with ion exchange properties, for example zeolites. Various types of zeolite are suitable, especially zeolite A, X, B, P, MAP and HS in their Na form or in forms in which Na has been replaced in part by other cations such as Li, K, Ca, Mg or ammonium. Suitable zeolites are described, for example, in EP-A 038 591, EP-A 021 491, EP-A 087 035, U.S. Pat. No. 4,604,224, GB-A2 013 259, EP-A 522 726, EP-A 384 070 and WO-A 94/24 251.

Further suitable inorganic builders are, for example, amorphous or crystalline silicates, for example amorphous disilicates, crystalline disilicates such as the phyllosilicate SKS-6 (manufacturer: Hoechst). The silicates can be employed in the form of their alkali metal, alkaline earth metal or ammonium salts. Preference is given to the use of Na, Li and Mg silicates.

ANIONIC SURFACTANTS

Examples of suitable anionic surfactants are fatty alcohol sulfates of fatty alcohols with 8 to 22, preferably 10 to 18 carbons, examples being $C_9$ to $C_{11}$ alcohol sulfates, $C_{12}$ to $C_{13}$ alcohol sulfates, cetyl sulfate, myristyl sulfate, palmityl sulfate, stearyl sulfate and tallow fatty alcohol sulfate.

Other suitable anionic surfactants are sulfated ethoxylated $C_8$ to $C_{22}$ alcohols (alkyl ether sulfates) and their soluble salts. Compounds of this kind are prepared, for example, by first of all alkoxylating a $C_8$ to $C_{22}$ alcohol, preferably a $C_{10}$ to $C_{18}$ alcohol, for example a fatty alcohol, and then sulfating the alkoxylation product. The alkoxylation is carried out preferably using ethylene oxide, in which case from 2 to 50 mol, preferably from 3 to 20 mol, of ethylene oxide are employed per mole of fatty alcohol. However, the alcohols can also be alkoxylated with propylene oxide alone and, if desired, butylene oxide. Suitability extends to those alkoxylated $C_{18}$ to $C_{22}$ alcohols which comprise ethylene oxide and propylene oxide or ethylene oxide and butylene oxide. The alkoxylated $C_8$ to $C_{22}$ alcohols can comprise the ethylene oxide, propylene oxide and butylene oxide units in the form of blocks or in random distribution.

Further suitable anionic surfactants are alkanesulfonates, such as $C_8$- to $C_{24}$-, preferably $C_{10}$- to $C_{18}$-alkanesulfonates, and also soaps, for example salts of $C_8$ to $C_{24}$ carboxylic acids.

Additional suitable anionic surfactants are $C_9$ to $C_{20}$ linear alkylbenzenesulfonates (LAS). Preferably, however, the compositions comprise little or no LAS.

Other suitable anionic surfactants are N-acylsarcosinates with aliphatic saturated or unsaturated $C_8$- to $C_{25}$-acyl radicals, preferably $C_{10}$- to $C_{20}$-acyl radicals, for example N-oleoylsarcosinate.

The anionic surfactants are added to the detergent preferably in the form of salts. Suitable cations in these salts are alkali metal salts such as sodium, potassium and lithium and ammonium salts such as, for example, hydroxyethylammonium, di(hydroxyethyl)ammonium and tri(hydroxyethyl)ammonium salts.

NONIONIC SURFACTANTS

Examples of suitable nonionic surfactants are alkoxylated $C_8$ to $C_{22}$ alcohols, such as fatty alcohol alkoxylates or oxo alcohol alkoxylates. Alkoxylation can be conducted with ethylene oxide, propylene oxide and/or butylene oxide. Surfactants which can be employed in this context are all alkoxylated alcohols which constitute adducts with at least two molecules of an abovementioned alkylene oxide. Also suitable in this context are block polymers of ethylene oxide, propylene oxide and/or butylene oxide, or adducts comprising these alkylene oxides in random distribution. For each mol of alcohol from 2 to 50 mol, preferably from 3 to 20 mol, of at least one alkylene oxide are used. The alkylene oxide employed is preferably ethylene oxide. The alcohols preferably have 10 to 18 carbons.

A further class of suitable nonionic surfactants comprises alkylphenol ethoxylates with $C_6$- to $C_{14}$-alkyl chains and from 5 to 30 mol of ethylene oxide units.

Another class of nonionic surfactants is that of alkylpolyglucosides having 8 to 22, preferably 10 to 18, carbons in the alkyl chain. These compounds usually contain 1 to 20, preferably 1.1 to 5, glucoside units.

Another class of nonionic surfactants is that of N-alkylglucamides of the formula II or III

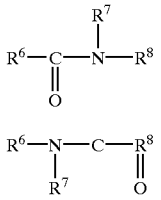

(II)

(III)

where $R^6$ is $C_6$- to $C_{22}$-alkyl, $R^7$ is H or $C_1$- to $C_4$-alkyl and $R^8$ is a polyhydroxyalkyl radical having 5 to 12 C atoms and at least 3 hydroxyl groups. Preferably, $R^6$ is $C_{10}$- to $C_{18}$-alkyl, $R^7$ is methyl and $R^8$ is a $C_5$ or $C_6$ radical. Compounds of this kind are obtained, for example, by the acylation of reductively aminated sugars with acid chlorides of $C_{10}$–$C_{18}$ carboxylic acids.

The detergents according to the invention preferably comprise $C_{10}$–$C_{16}$ alcohols ethoxylated with 3–12 mol of ethylene oxide, with particular preference ethoxylated fatty alcohols, as nonionic surfactants.

ORGANIC COBUILDERS

Examples of low molecular mass polycarboxylates suitable as organic cobuilders are:

- $C_4$ to $C_{20}$ di-, tri- and tetracarboxylic acids, for example succinic, propanetricarboxylic, butanetetracarboxylic, cyclopentanetetracarboxylic and alkyl- and alkenylsuccinic acids having $C_{12}$–$C_{16}$-alkyl or -alkenyl radicals;
- $C_4$- to $C_{20}$ hydroxycarboxylic acids, for example malic, tartaric, gluconic, glucaric, citric and lactobionic acid and sucrose mono-, -di- and -tricarboxylic acid;
- aminopolycarboxylates, for example nitrilotriacetic, methylglycinediacetic, alaninediacetic, ethylenediaminetetraacetic and serinediacetic acid;
- salts of phosphonic acids such as hydroxyethanediphosphonic acid, ethylenediaminetetra (methylenephosphonate) and diethylenetriaminepenta (methylenephosphonate).

Examples of oligomeric or polymeric polycarboxylates which are suitable as organic cobuilders are:

- Oligomaleic acids, as described, for example, in EP-A-451 508 and EP-A-396 303;
- co- and terpolymers of unsaturated $C_4$–$C_8$ dicarboxylic acids, which as comonomers may comprise—in copolymerized form—monoethylenically unsaturated monomers
  - from group (i) in amounts of up to 95% by weight,
  - from group (ii) in amounts of up to 60% by weight, and
  - from group (iii) in amounts of up to 20% by weight.

Examples of suitable unsaturated $C_4$–$C_8$ dicarboxylic acids in this context are maleic, fumaric, itaconic and citraconic acid. Preference is given to maleic acid.

The group (i) comprises monoethylenically unsaturated $C_3$–$C_8$ monocarboxylic acids, for example acrylic, methacrylic, crotonic and vinylacetic acid. From the group (i), preference is given to using acrylic and methacrylic acid.

The group (ii) comprises monoethylenically unsaturated $C_2$–$C_{22}$-olefins, vinyl alkyl ethers with $C_1$–$C_8$-alkyl groups, styrene, vinyl esters of $C_1$–$C_8$ carboxylic acids, (meth) acrylamide and vinylpyrrolidone. From the group (ii) preference is given to the use of $C_2$–$C_6$ olefins, vinyl alkyl ethers having $C_1$–$C_4$ alkyl groups, vinyl acetate and vinyl propionate.

The group (iii) comprises (meth)acrylic esters of $C_1$ to $C_8$ alcohols, (meth)acrylonitrile, (meth)acrylamides of $C_1$–$C_8$ amines, N-vinylformamide and vinylimidazole.

If the polymers of group (ii) comprise vinyl esters in copolymerized form, these may also be present, in whole or in part, in the form in which they have been hydrolyzed to vinyl alcohol structural units. Appropriate co- and terpolymers are known, for example, from U.S. Pat. No. 3,887,806 and from DE-A 43 13 909.

As copolymers of dicarboxylic acids, suitable organic cobuilders are preferably:

- copolymers of maleic acid and acrylic acid in a weight ratio of from 10:90 to 95:5, particularly preferably those in a weight ratio of from 30:70 to 90:10, with molar masses of from 10,000 to 150,000;

terpolymers of maleic acid, acrylic acid and a vinyl ester of a $C_1$–$C_3$ carboxylic acid in a weight ratio of from 10(maleic acid):90(acrylic acid+vinyl ester) to 95(maleic acid):5(acrylic acid+vinyl ester), the weight ratio of acrylic acid to vinyl ester varying in the range from 20:80 to 80:20, and, with particular preference, terpolymers of maleic acid, acrylic acid and vinyl acetate or vinyl propionate in a weight ratio of from 20(maleic acid):80(acrylic acid+vinyl ester) to 90(maleic acid):10 (acrylic acid+vinyl ester) the weight ratio of acrylic acid to the vinyl ester varying in the range from 30:70 to 70:30;

copolymers of maleic acid with $C_2$–$C_8$-olefins in a molar ratio of from 40:60 to 80:20, particular preference being given to copolymers of maleic acid with ethylene, propylene or isobutene in a molar ratio of 50:50.

Graft polymers of unsaturated carboxylic acids on low molecular mass carbohydrates or hydrogenated carbohydrates—cf. U.S. Pat. No. 5,227,446, DE-A-44 15 623, DE-A-43 13 909—are likewise suitable as organic cobuilders.

Examples of suitable unsaturated carboxylic acids in this context are maleic, fumaric, itaconic, citraconic, acrylic, methacrylic, crotonic and vinylacetic acid and also mixtures of acrylic and maleic acid, which are grafted on in amounts of from 40 to 95% by weight, based on the component to be grafted.

For modification it is additionally possible for up to 30% by weight, based on the component to be grafted, of further monoethylenically unsaturated monomers to be present in copolymerized form. Suitable modifying monomers are the abovementioned monomers of groups (ii) and (iii).

Suitable graft bases are degraded polysaccharides, for example acidic or enzymatically degraded starches, inulins or cellulose, reduced (hydrogenated or reductively aminated) polysaccharides, for example mannitol, sorbitol, aminosorbitol and glucamine, and also polyalkylene glycols having molar masses up to $M_w$=5000, for example polyethylene glycols, ethylene oxide/propylene oxide or ethylene oxide/butylene oxide block copolymers, random ethylene oxide/propylene oxide or ethylene oxide/butylene oxide copolymers, or alkoxylated mono- or polyhydric $C_1$–$C_{22}$ alcohols—cf. U.S. Pat No. 4,746,456.

From this group, preference is given to the use of grafted, degraded or degraded, reduced starches and grafted polyethylene oxides, in which case from 20 to 80% by weight of monomers, based on the graft component, are employed in the graft polymerization. Grafting is preferably carried out using a mixture of maleic and acrylic acid in a weight ratio of from 90:10 to 10:90.

Polyglyoxylic acids as organic cobuilders are described, for example, in EP-B-001 004, U.S. Pat. No. 5,399,286, DE-A-41 06 355 and EP-A-656 914. The endgroups of the polyglyoxylic acids can have different structures.

Polyamidocarboxylic acids and modified polyamidocarboxylic acids as organic cobuilders are known, for example, from EP-A-454 126, EP-B-511 037, WO-A 94/01486 and EP-A-581 452.

As organic cobuilders use is also made, preferably, of polyaspartic acid or cocondensates of aspartic acid with other amino acids, $C_4$–$C_{25}$ mono- or dicarboxylic acids and/or $C_4$–$C_{25}$ mono- or diamines. Particular preference is given to the use of polyaspartic acids prepared in phosphorus-containing acids and modified with $C_6$–$C_{22}$ mono- or dicarboxylic acids or with $C_6$–$C_{22}$ mono- or diamines.

Condensation products of citric acid with hydroxycarboxylic acids or polyhydroxy compounds as organic cobuilders are known, for example, from WO-A 93/22362 and WO-A 92/16493. Carboxyl-containing condensates of this kind usually have molar masses of up to 10,000, preferably up to 5000.

GRAYING INHIBITORS AND SOIL RELEASE POLYMERS

Suitable soil release polymers and/or graying inhibitors (antiredeposition agents) for detergents are, for example:

polyesters of polyethylene oxides with ethylene glycol and/or propylene glycol and aromatic dicarboxylic acids or aromatic and aliphatic dicarboxylic acids;

polyesters of polyethylene oxides, end group-capped at one end, with di- and/or polyhydric alcohols and dicarboxylic acid.

Polyesters of this kind are known, for example, from U.S. Pat. No. 3,557,039, GB-A 1 154 730, EP-A-185 427, EP-A-241 984, EP-A-241 985, EP-A-272 033 and U.S. Pat. No. 5,142,020.

Other suitable soil release polymers are amphiphilic graft polymers or copolymers of vinyl esters and/or acrylic esters on polyalkylene oxides (cf. U.S. Pat. No. 4,746,456, U.S. Pat. No. 4,846,995, DE-A-37 11 299, U.S. Pat. No. 4,904,408, U.S. Pat. No. 4,846,994 and U.S. Pat. No. 4,849,126) or modified celluloses, for example methylcellulose, hydroxypropylcellulose or carboxymethylcellulose.

Color Transfer Inhibitors

Examples of compounds used as color transfer inhibitors are homo- and copolymers of vinylpyrrolidone, of vinylimidazole, of vinyloxazolidone and of 4-vinylpyridine N-oxide with molar masses of from 15,000 to 100,000, and also crosslinked, finely divided polymers based on these monomers. This use of such polymers is known; cf. DE-B-22 32 353, DE-A-28 14 287, DE-A-28 14 329 and DE-A-43 16 023.

Enzymes

In accordance with one embodiment of the invention the bleach compositions comprising at least one bleach activator are used in enzyme-containing detergents and cleaning products. In this case examples of suitable enzymes are proteases, amylases, lipases and cellulases, especially proteases. It is possible to use two or more enzymes in combination.

In addition to use in detergents and cleaning products for domestic washing of textiles, the bleach compositions that can be used in accordance with the invention can also be employed in the sector of commercial textile washing and commercial cleaning. In this field, the bleach generally employed is peracetic acid, which is added to the washing liquor as an aqueous solution. In this application, the activator used in accordance with the invention can be added either separately, as an individual component, in the washing or cleaning process, or mixed beforehand with other ingredients, which are then added conjointly.

Novel bleach additives for washing textiles comprise from 1 to 30% by weight, based on the overall amount of bleach additive, of at least one activator according to the invention.

Novel dishwashing compositions preferably comprise from 0.05 to 15% by weight, based on the overall amount of dishwashing composition, of at least one activator according to the invention.

Novel disinfectants preferably comprise from 1 to 40% by weight, based on the overall amount of disinfectant, of at least one activator according to the invention.

Novel detergents and bleaches for washing textiles preferably comprise from 0.1 to 20% by weight, based on the overall amount of the detergent and bleach, of at least one activator according to the invention.

In accordance with one embodiment, the textile detergents comprising at least one activator according to the invention, with a bleaching system based on peroxy compounds and percarboxylic acids, comprise from 0.5 to 40% by weight, preferably from 2.5 to 30% by weight and, with particular preference, from 5 to 25% by weight of peroxy compounds or peracids, from 0 to 20% by weight, preferably from 0.1 to 20% by weight, in particular from 0.5 to 10% by weight and, with particular preference, from 0.5 to 6.0% by weight of bleach activators according to the invention, and from 0 to 5% by weight, preferably from 0.05 to 2% by weight and, with particular preference, from 0.1 to 1% by weight of at least one bleach catalyst.

When the activators according to the invention are used it is possible to bring about a considerable improvement in the performance of bleach compositions, especially in the case of cold bleach compositions and in particular in relation to hydrophobic soiling. Weaknesses of customary commercial bleach activators can be specifically compensated by the use of activators according to the invention, so that a bleach which is powerful at low temperatures is possible.

The bleach activators to be used in accordance with the invention are preferably employed in pulverulent or granular detergents. These may be conventional heavy-duty detergents or concentrated or compact detergents.

A typical pulverulent or granular heavy-duty detergent according to the invention can, for example, have the following composition:

- from 0.5 to 50% by weight, preferably from 5 to 30% by weight, of at least one anionic and/or nonionic surfactant,
- from 0.5 to 60% by weight, preferably from 15 to 40% by weight, of at least one inorganic builder,
- from 0 to 20% by weight, preferably from 0.5 to 8% by weight, of at least one organic cobuilder, from 2 to 35% by weight, preferably from 5 to 30% by weight, of an inorganic bleach such as perborate or percarbonate,
- from 0.1 to 20% by weight, preferably from 0.5 to 10% by weight, of a bleach activator according to the invention, alone or in a blend with other bleach activators,
- from 0 to 1% by weight, preferably not more than 0.5% by weight, of a bleach catalyst,
- from 0 to 5% by weight, preferably from 0 to 2.5% by weight, of a polymeric color transfer inhibitor,
- from 0 to 1.5% by weight, preferably from 0.1 to 1.0% by weight, of protease,
- from 0 to 1.5% by weight, preferably from 0.1 to 1.0% by weight, of lipase,
- from 0 to 1.5% by weight, preferably from 0.2 to 1.0% by weight, of a soil release polymer, and, to 100%, customary auxiliaries and adjuncts and water.

Inorganic builders which are preferably employed in detergents are sodium carbonate, sodium hydrogen carbonate, zeolites A and P, and amorphous and crystal-line Na silicates.

Organic cobuilders which are preferably employed in detergents are acrylic acid/maleic acid copolymers, acrylic acid/maleic acid/vinyl ester terpolymers, and citric acid.

Inorganic bleaches which are preferably employed in detergents are sodium perborate and sodium carbonate perhydrate.

Inorganic surfactants which are preferably employed in detergents are fatty alcohol sulfates, linear alkylbenzenesulfonates (LAS) and soaps, the proportion of LAS preferably being below 8% by weight, particularly preferably below 4% by weight.

According to one embodiment of the invention the textile detergent according to the invention is essentially free from linear alkylbenzenesulfonates and is preferably formulated on the basis of fatty alcohol sulfonates.

According to one embodiment of the invention the textile detergent composition is essentially free from phosphate.

According to one embodiment of the invention the textile detergent composition according to the invention includes at least one polycarboxylate, preferably in an amount of from 0.1 to 7.5% by weight.

Nonionic surfactants that are preferably employed in detergents are $C_{11}$ to $C_{17}$ oxo alcohol ethoxylates with 3–13 ethylene oxide units, $C_{10}$ to $C_{16}$ fatty alcohol ethoxylates with 3–13 ethylene oxide units, and also ethoxylated fatty alcohols or oxo alcohols which are additionally alkoxylated with 1–4 propylene oxide or butylene oxide units.

Enzymes preferably employed in detergents are protease, lipase and cellulase. Of the customary commercial enzymes, amounts of in general from 0.05 to 2.0% by weight, preferably from 0.2 to 1.5% by weight, of the formulated enzyme are added to the detergent. Examples of suitable proteases are Savinase, Desazym and Esperase (produced by Novo Nordisk). An example of a suitable lipase is Lipolase (manufactured by Novo Nordisk). An example of a suitable cellulase is Celluzym (manufactured by Novo Nordisk).

Graying inhibitors and soil release polymers which are preferably employed in detergents are graft polymers of vinyl acetate on polyethylene oxide with a molar mass of 2500–8000 in a weight ratio of from 1.2:1 to 3.0:1, polyethylene terephthalates/oxyethylene terephthalates with a molar mass of 3000 to 25,000 of polyethylene oxides with a molar mass of 750 to 5000 with terephthalic acid and ethylene oxide and with a molar ratio of polyethylene terephthalate to polyoxyethylene terephthalate of from 8:1 to 1:1, and block polycondensates according to DE-A-44 03 866.

Color transfer inhibitors which are preferably employed in detergents are soluble vinylpyrrolidone and vinylimidazole copolymers with molar masses of more than 25,000, and finely divided crosslinked polymers based on vinylimidazole.

The pulverulent or granular detergents according to the invention can include up to 60% by weight of inorganic extenders. Sodium sulfate usually performs this function. However, the detergents according to the invention are preferably low in extenders and contain only up to 20% by weight, particularly preferably only up to 8% by weight, of extenders.

The detergents according to the invention can have various bulk densities in the range from 300 to 1200, in particular 500 to 950 g/l. Modern compact detergents generally have high bulk densities and a granular structure.

In addition to being formulated as combined detergents and bleaches, the bleach activators for washing textiles that are described can also be employed as compositions which are used as additives to peroxide-containing or peroxide-free detergents. These compositions essentially comprise the activator or a bleach composition, comprising bleach, bleach activator according to the invention, and, if desired, further auxiliaries and additives, especially stabilizers, pH regulators, thickeners and surfactants.

The present invention additionally provides bleach additives for washing textiles which comprise from 1 to 30% by weight, preferably from 5 to 25% by weight, based on the overall amount of the bleach additives, of one or more activators according to the invention.

Typical bleach additives of this kind have approximately the following composition:

- from 5 to 50% by weight, preferably from 15 to 35% by weight, of inorganic per compound,
- from 1 to 30% by weight, preferably from 5 to 25% by weight, of at least one bleach activator according to the invention,
- from 0 to 5% by weight, preferably from 0.1 to 3% by weight, of peroxide stabilizers,
- from 0 to 40% by weight, preferably from 5 to 30% by weight, of pH regulators,
- and, to 100 by weight, other customary auxiliaries and additives.

The present invention also provides dishwashing composition which comprise from 0.05 to 15% by weight, preferably from 0.1 to 10% by weight and, in particular, from 0.5 to 5% by weight, based in each case on the overall amount of the dishwashing composition, of one or more bleach activators in addition to the constituents which are customary in this context.

Products intended for the cleaning of hard surfaces generally comprise, in addition to per compound and activator, in particular, surfactants, builders and, in the case of polishing and scouring compositions, abrasive constituents as well. Since these compositions are frequently employed at room temperature, the use of the activators according to the invention has a particularly advantageous effect on the bleaching and germicidal action in this case.

Formulated compositions are of particular importance in connection with their application in disinfection, since for this utility there are generally heightened requirements placed on safety in use. Disinfectants based on the activators described generally comprise, in addition to. these and inorganic per compounds, further auxiliaries and additives, such as pH regulators, stabilizers and surfactants. In particular cases they may additionally include specific microbicides which intensify the per se very broad germicidal action of the activated per compound with respect to particular microbes.

The present invention additionally provides disinfectants which comprise from 1 to 40% by weight, preferably from 5 to 30% by weight, based on the overall amount of disinfectant, of one or more activators according to the invention.

Typical disinfectants of this kind have, for instance, the following composition:

- from 5 to 40% by weight, preferably from 10 to 20% by weight of inorganic per compound,
- from 1 to 40% by weight, preferably from 5 to 30% by weight, of at least one activator according to the invention,
- from 0 to 5% by weight, preferably from 0.1 to 3% by weight, of peroxide stabilizers,
- from 0.1 to 20% by weight, preferably from 0.2 to 5% by weight, of surfactants,
- and, to 100% by weight, further auxiliaries and additives.

The use of the described activators in accordance with the invention is not restricted to their use in formulated form as has been described by way of example above. In the commercial sector for example, the reagents are generally metered in individually, since this is often the most cost-effective procedure.

Using the bleach activators according to the invention it is possible to obtain a marked improvement in the bleaching, oxidizing and cleaning action in the lower temperature range in the context of the technical utilities described.

The invention also provides a method of washing or cleaning or disinfecting articles or textiles with an aqueous liquor, preferably a liquor with a concentration of from 0.2 to 10% by weight, of a detergent and bleach, dishwashing composition or disinfectant, as described above.

PREPARATION EXAMPLES

General preparation procedure for hydroxyimide carbonates (reaction of hydroxyimides with alkyl chloroformates):

0.2 mol of hydroxyimide is charged to about 150 ml of toluene at from 10 to 15° C., 0.2 mol of dimethylcyclohexylamine in about 50 ml of toluene and 0.2 mol of alkyl chloroformate in 50 ml of toluene are added dropwise in parallel over the course of half an hour, with cooling, and the mixture is subsequently stirred at room temperature for about 0.5 to 4 hours. The reaction mixture is worked up by either filtering off the precipitated hydrochloride with suction or removing it by extraction with water. The resulting toluene phase is dried over sodium sulfate, if desired, and concentrated. The desired hydroxyimide carbonate is obtained in a yield of more than 90%.

General preparation procedure for hydroxyimide esters (reaction of hydroxyimides with acid chlorides):

0.2 mol of hydroxyimide and 0.2 mol of dimethylcyclohexylamine are charged to about 150 ml of toluene at room temperature, 0.2 mol of the desired acid chloride in 50 ml of toluene are added dropwise over the course of half an hour, with cooling if desired, and the mixture is subsequently stirred at a temperature which may be slightly elevated if desired (to about 70° C.) for about 0.5 to 4 hours. The progress of the reaction is monitored by means of TLC. The reaction mixture is worked up by either filtering off the precipitated hydrochloride with suction or removing it by extraction with water. The resulting toluene phase is dried with sodium sulfate, if desired, and concentrated. The desired hydroxyimide ester is obtained in a yield of more than 90%. For preparing the carbonates, phosgene is employed in particular as the acid chloride.

The following bleach activators were obtained in accordance with the above preparation procedures:

Example 1

N-(2-propylheptyloxycarbonyl)oxyphthalimide

Example 2

N-(phenyloxycarbonyl)oxycyclohex-4-ene-1,2-dicarboximide

Example 3

O-(methyloxycarbonyl)acetone oxime

Example 4

O-(benzyloxycarbonyl)acetone oxime

Example 5

O-(n-butyloxycarbonyl)acetone oxime

The bleach activators according to the invention can be formulated in the exemplary compositions of heavy-duty detergents as indicated below.

TABLE 1

Compositions of heavy-duty detergents

| | I | II | III | IV | V | VI | VII |
|---|---|---|---|---|---|---|---|
| PVP (K value 30) | 1.5 | | | | | | |
| VI/VP copolymer (K value 30) | | 1.0 | | | 1.0 | 0.6 | |
| AA/MA (M = 70,000) | | | 5.0 | | | | |
| AA/MA (M = 10,000 | | | | | | | 5.0 |
| AA/MA/VAc terpolymer (M = 20,000) | | | | | | 5.0 | |
| Oligomaleic acid | | | | | 5.0 | | |
| Polyaspartic acid | 7.5 | | | | | | |
| Na perboric monohydrate | 15 | 15 | | | 15 | | 7.5 |
| Na percarbonate | | | 18 | 15 | | 18 | |
| Bleach activator from the Ex. | 4.0 | 3.8 | 5.0 | 5.0 | 2.9 | 4.2 | 2.0 |
| Na lauryl sulfate | 3.5 | 6.0 | 12.0 | 6.0 | 5.5 | 2.0 | |
| Linear alkylbenzenesulfonate Na salt | | 1.7 | 0.8 | | | 4.5 | |
| Soap | 2.8 | 0.6 | 0.4 | 2.5 | 1.5 | | 2.4 |
| $C_{13}/C_{15}$ oxo alcohol * 3 EO | | 3.0 | | | | | |
| $C_{13}/C_{15}$ oxo alcohol * 7 EO | 4.7 | | 4.7 | 13.5 | 4.0 | 6.5 | |
| $C_{13}/C_{15}$ oxo alcohol * 10 EO | | 3.0 | | | | | |
| $C_{12}/C_{14}$ fatty alcohol * 7 EO | | | | | | | 10.0 |
| Lauryl alcohol * 13 EO | | | | | | 5.0 | |
| Zeolite A | 25 | 25 | 15 | | 30 | 15 | 35 |
| Zeolite P | | | | 40 | | | |
| SKS-6 ® | | | 14 | | | 15 | |
| Na disilicate | 2.5 | 3.9 | | 0.5 | 4.5 | | 1.5 |
| Mg silicate | 1.0 | | 0.8 | | 1.0 | 1.0 | 0.6 |
| Sodium sulfate | 15 | 2.5 | 3.2 | 2.0 | 1.5 | 5.5 | 3.4 |
| Sodium hydrogen carbonate | | | 9.0 | 6.5 | | | |
| Sodium carbonate | 12.0 | 13.6 | | | 10.0 | 8.0 | 9.8 |
| Soil release polymer 1 | | 0.4 | | | 0.5 | | |
| Soil release polymer 2 | 1.0 | | | | 0.5 | 0.8 | 1.0 |
| Carboxymethylcellulose | 0.6 | 1.3 | 0.6 | 1.0 | 0.6 | 0.6 | 0.5 |
| Dequest 2046 ® (phosphonate) | | | | 0.5 | | | |
| Citric acid | | 6.8 | 5.0 | | | 2.5 | 3.8 |
| Lipase | | | | | 1.0 | | |
| Protease | | 1.0 | | | 1.0 | 0.5 | 0.6 |
| Cellulase | | | | | | | 0.6 |
| Water | to 100 | to 100 | to 100 | to 100 | to 100 | to 100 | to 100 |

Soil release polymer 1 = Graft polymer of vinyl acetate on polyethylene glycol of molar mass 6000, molar mass of the graft polymer 24,000 (Sokolan ® HP22 from BASF AG)
Soil release polymer 2 = Polyethylene terephthalate/polyoxyethylene terephthalate of molar mass 8000
Dequest 2046 ® = Ethylenediamine-N,N,N',N'-tetra (methylenephosphonate)
SKS-6 ® = Commercial phyllosilicate, manufacturer: Hoechst AG The investigations below were carried out using the above-described detergent composition III. To test the action of the bleach activators according to the invention, test stains of tea on cotton, red wine on cotton, micronized carotene in vegetable oil on cotton and chlorophyll/vegetable oil on cotton were produced and washing experiments with the detergent composition III were carried out. These washing operations were effected in a Launder-O-meter, model Atlas Standard, under the following conditions:

TABLE 2

| Washing conditions | |
|---|---|
| Machine | Launder-O-meter |
| Cycles | 1 |
| Duration | 30 min |
| Temperatures | 22° C. and 38° C. |
| Water hardness | 3.0 mmol/l |
| Test fabric | 3 or 4 × 2.5 g of different test fabrics (bleached cotton stained with chlorophyll/vegetable oil or carotene/vegetable oil, tea and red wine, and 2.5 g of untreated cotton fabric) |
| Liquor volume | 250 ml |
| Liquor ratio | 1:20 |
| Detergent | No. III from Tab. 1 using the activator indicated in Tab. 3 |
| Detergent concentration | 4.5 g/l |

The bleaching action of the detergent composition was determined from the measurement of the depth of color of the test fabrics. This measurement was carried out photometrically. From the reflectances measured for the individual test fabrics at 16 wavelengths in the range from 400 to 700 nm at 20 nm intervals the respective depth of color of the test stains before and after washing were determined in accordance with the method described in A. Kud, Seifen, Öle, Fette, Wachse 119 (1993) 590–594 and were used to calculate the absolute bleaching action $A_{abs}$ in %, which is defined as follows:

$$A_{abs} = \frac{\text{depth of color (before washing)} - \text{depth of color (after washing)}}{\text{depth of color (before washing)} - \text{depth of color (white fabric)}} \cdot 100\%$$

The amount of activator used in this context in the examples below was 5.0% by weight. At the same time, comparison experiments were also carried out, without the use of a bleach activator, and using TAED as bleach activator.

The results of the experiments are summarized in Table 3 below:

TABLE 3

Results of washing experiments with stained test fabric
Numerical values are absolute bleaching action $A_{abs}$ in %

| | Carotene | | Tea | | Red wine | | Chlorophyll | |
|---|---|---|---|---|---|---|---|---|
| Bleach activator | 22° C. | 38° C. | 22° C. | 38° C. | 22° C. | 38° C. | 22° C. | 38° C. |
| * TAED | 49.9 | 50.8 | 47.5 | 71.5 | 68.3 | 81.9 | 5.9 | 12.2 |
| * no activator | 48.7 | 53.16 | 22.9 | 46.6 | 57.8 | 68.4 | 4.5 | 7.7 |
| Example No. 1 | 58.5 | 65.6 | 62.7 | 74.8 | 65.1 | 74.0 | 29.2 | 35.8 |
| Example No. 2 | 52.1 | 56.0 | 45.5 | 72.9 | 67.1 | 77.9 | 9.9 | 18.2 |
| Example No. 3 | | | 54.7 | 79.0 | 70.0 | 83.5 | 10.6 | 19.1 |
| Example No. 4 | | | 70.2 | 79.3 | 69.0 | 81.8 | 22.8 | 25.3 |
| Example No. 5 | | | 66.3 | 79.4 | 66.6 | 82.7 | 17.7 | 23.6 |

* = Comparison experiments

The washing experiments with the bleach activators according to the invention show that the bleach activators exhibit a pronounced intensification of the bleaching action, which is improved relative to the comparison bleach activator in the case of some types of soiling, especially tea and chlorophyll.

We claim:

1. A method of activating inorganic per compounds, comprising contacting an inorganic per compound with a compound selected from the group consisting of (1) a carbonate represented by formula (I):

$$A—O—CO—OR^3 \quad (I)$$

wherein

A is a radical represented by formula (Ia):

$$R^1R^2C{=}N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1$=$CHR^2$ in which $R^1$ and $R^2$ are as defined above, (2) a polymer which can comprise $C_{2-8}$ olefin comonomer units and comprise base units represented by formulae (IV) and/or (V):

(IV)

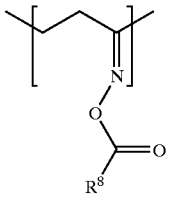

(V)

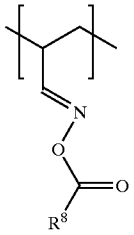

wherein $R^8$ is a radical $R^3$ or —$OR^3$ wherein $R^3$ is as defined above.

2. A method as claimed in claim 1, where $R^1$ and $R^2$ are each, independently, a $C_{1-4}$-alkyl radicals and $R^3$ is a $C_{1-10}$-alkyl radical, phenyl or benzyl.

3. A method as claimed in claim 1, in which said activation is carried out in detergents, cleaning products, bleaches and disinfectants.

4. A detergent and bleach for washing textiles, comprising from 0.1 to 20% by weight of at least one compound selected from the group consisting of (1) a carbonate represented by formula (I):

$$A—O—CO—OR^3 \quad (I)$$

wherein

A is a radical represented by formula (Ia):

$$R^1R^2C{=}N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1$=$CHR^2$ in which $R^1$ and $R^2$ are as defined above, (2) a polymer which can comprise $C_{2-8}$ olefin comonomer units and comprise base units represented by formulae (IV) and/or (V):

(IV)

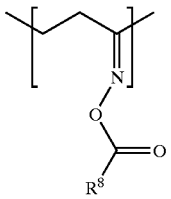

-continued (V)

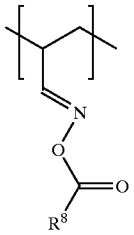

wherein $R^8$ is a radical $R^3$ or —$OR^3$ wherein $R^3$ is as defined above.

5. A detergent comprising from 0.1 to 20% by weight of at least one compound selected from the group consisting of (1) a carbonate represented by formula (I):

$$A—O—CO—OR^3 \quad (I)$$

wherein

A is a radical represented by formula (Ia):

$$R^1R^2C{=}N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1{=}CHR^2$ in which $R^1$ and $R^2$ are as defined above, (2) a polymer which can comprise $C_{2-8}$ olefin comonomer units and comprise base units represented by formulae (IV) and/or (V):

(IV)

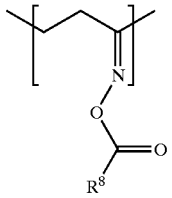

(V)

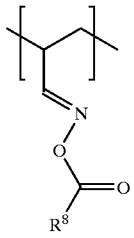

where $R^8$ is a radical $R^3$ or —$OR^3$ wherein $R^3$ is as defined above, from 5 to 30% by weight of at least one anionic and/or nonionic surfactant, from 5 to 30% by weight of at least one inorganic builder, from 5 to 30% by weight of at least one inorganic bleach, and from 0.2 to 2.0% by weight of enzymes, the overall amount of the ingredients of the detergent being 100% by weight.

6. A bleach additive for washing textiles, comprising from 1 to 30% by weight, based on the overall amount of the bleach additive, of at least one compound selected from the group consisting of (1) a carbonate represented by formula (I):

$$A—O—CO—OR^3 \quad (I)$$

wherein

A is a radical represented by formula (Ia):

$$R^1R^2C{=}N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1$=$CHR^2$ in which $R^1$ and $R^2$ are as defined above, (2) a polymer which can comprise $C_{2-8}$ olefin comonomer units and comprise base units represented by formulae (IV) and/or (V):

(IV)

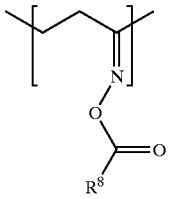

(V)

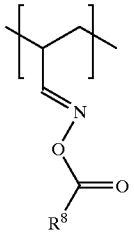

wherein $R^8$ is a radical $R^3$ or —$OR^3$ wherein $R^3$ is as defined above.

7. A dishwashing composition comprising from 0.05 to 5% by weight, based on the overall amount of the dishwashing composition, of at least one compound selected from the group consisting of (1) a carbonate represented by formula (I):

$$A—O—CO—OR^3 \quad (I)$$

wherein

A is a radical represented by formula (Ia):

$$R^1R^2C=N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1$=$CHR^2$ in which $R^1$ and $R^2$ are as defined above, (2) a polymer which can comprise $C_{2-8}$ olefin comonomer units and comprise base units represented by formulae (IV) and/or (V):

(IV)

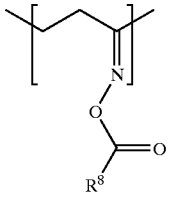

(V)

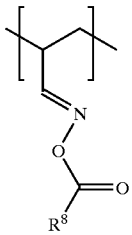

wherein $R^8$ is a radical $R^3$ or —$OR^3$ wherein $R^3$ is as defined above.

8. A disinfectant comprising from 1 to 40% by weight, based on the overall amount of the disinfectant, of at least one compound selected from the group consisting of (1) a carbonate represented by formula (I):

$$A—O—CO—OR^3 \quad (I)$$

wherein

A is a radical represented by formula (Ia):

$$R^1R^2C=N— \quad (Ia)$$

wherein $R^1$, $R^2$ and $R^3$ are each, independently, a straight-chain or branched $C_{1-30}$-alkyl, $C_{2-30}$-alkenyl, $C_{5-18}$-cycloalkyl, $C_{7-18}$-aralkyl or $C_{6-18}$-aryl or heteroaryl, it being possible for aliphatic radicals to be functionalized additionally by 1 to 5 hydroxyl, $C_{1-4}$-alkoxy, amino, $C_{1-4}$-alkoxyamino, di-$C_{1-4}$-alkylamino, nitro, cyano, carboxyl, sulfo, carboxy-$C_{1-4}$-alkyl or carboxamide groups, chlorine or bromine atoms or by phenyl, tolyl or benzyl, it likewise being possible for aromatic, cycloaliphatic and heteroaromatic structural units to be substituted by these functions or to be interrupted by 1 to 8 nonadjacent oxygens or amino, $C_{1-4}$-alkylamino or carbonyl groups, and $R^1$ and $R^2$, furthermore, can be hydrogen or together form a 1,3-, 1,4-, 1,5-, 1,6-, 1,7- or 1,8-alkylene group of 3 to 33 C atoms which can be functionalized additionally by 1 to 5 hydroxyl, $C_{1-4}$-alkylamino, di-$C_{1-4}$-alkylamino, nitro, cyano, carboxyl, sulfo, carboxy-$C_{1-4}$-alkyl or carboxamide groups, chlorine or bromine atoms or phenyl, tolyl or benzyl, and where aromatic radicals in turn can likewise be substituted by these functions, or can be interrupted by one or two nonadjacent oxygens or amino, $C_{1-4}$-alkylamino or carbonyl groups, and $R^3$ is not a vinyl which can be substituted by a carboxylic, sulfonic or phosphonic acid group or an alkali metal salt or ammonium salt thereof and is not a vinyloxy radical —O—$CR^1$=$CHR^2$ in which $R^1$ and $R^2$ are as defined above, (2) a polymer which can comprise $C_{2-8}$ olefin comonomer units and comprise base units represented by formulae (IV) and/or (V):

(IV)

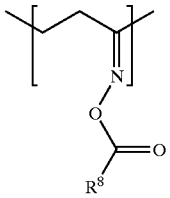

(V)

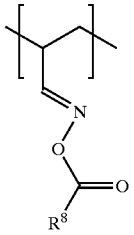

wherein $R^8$ is a radical $R^3$ or —$OR^3$ wherein $R^3$ is as defined above.

9. The method of claim 1, wherein $R^1$ and $R^2$ are ethyl.

10. The method of claim 1, wherein $R^1$ and $R^2$ are $C_{2-6}$-alkenyl groups.

11. The method of claim 1, wherein $R^1$ and $R^2$ are independently substituents selected from the group consisting of cyclopentyl, cyclohexyl, 2-methylcyclohexyl, 3-methylcyclohexyl, 4-methylcyclohexyl, 2,3-dimethylcyclohexyl, 2,4-dimethylcyclohexyl, 2,5-dimethylcyclohexyl, 2,6-dimethylcyclohexyl, cycloheptyl, and cyclooctyl.

12. The method of claim 1, wherein $R^1$ and $R^2$ are independently substituents selected from the group consisting of benzyl, 2-methylbenzyl, 3-methylbenzyl, 4-methylbenzyl, 2-phenylethyl, 3-phenylpropyl, 4-phenylbutyl, 2-ethylbenzyl, 3-ethylbenzyl, 4-ethylbenzyl, 3-isopropylbenzyl, 4-isopropylbenzyl, 2-butylbenzyl, and 4-butylbenzyl.

13. The method of claim 1, wherein $R^1$ and $R^2$ are independently substituents selected from the group consisting of phenyl, 2-methylphenyl, 3-methylphenyl, 4-methylphenyl, 2-ethylphenyl, 3-ethylphenyl, 4-ethylphenyl, 3-isopropylphenyl, 4-isopropylphenyl, 3-butylphenyl, 4-butylphenyl, 3-(2'-ethylhexyl)phenyl, and 4-(2'-ethylhexyl)phenyl.

14. The method of claim 1, wherein $R^1$ and $R^2$ are independently substituents selected from the group consisting of pyridine, furan, thiophene, pyrole, imidazole, pyrazole, thiazole, pyrazine, and pyrimidine rings.

15. The method of claim 1, wherein $R^1$ and $R^2$ are independently substituents selected from the group consisting of a methylethylaminoethyl group reacted with 1 to 8 ethylene oxide units, a dimethylaminomethyl group reacted with 1 to 8 ethylene oxide units, a methoxymethyl group reacted with 1 to 8 ethylene oxide units, a methoxyethyl group reacted with 1 to 8 ethylene oxide units, an ethoxyethyl group reacted with 1 to 8 ethylene oxide units, an ethoxyethyl group reacted with 1 to 8 ethylene oxide units, a hydroxyethyl group reacted with 1 to 8 ethylene oxide units, a methoxybutyl group reacted with 1 to 5 propylene oxide units, a methoxypropyl group reacted with 1 to 5 propylene oxide units, a 2-methoxy-1-methylethyl group reacted with 1 to 5 propylene oxide units, and a 2-hydroxy-1-methylethyl group reacted with 1 to 5 propylene oxide units.

16. The method of claim 1, wherein $R^1$ and $R^2$ together form a propylene group, a 1-methyl substituted propylene group, a 2-methyl substituted propylene group, a 3-methyl substituted propylene group, a 1-ethyl substituted propylene group, a 2-ethyl substituted propylene group, a 3-ethyl substituted propylene group, a 1-propyl substituted propylene group, a 2-propyl substituted propylene group, a 3-propyl substituted propylene group, a 1-butyl substituted propylene group, a 2-butyl substituted propylene group, a 3-butyl substituted propylene group, a butylene group, a 1-methylbutylene group, a 2-methylbutylene group, a 1,2-dimethylbutylene group, 1,3-dimethylbutylene group, 1,4-dimethylbutylene group, a 1-ethylbutylene group, a 2-ethylbutylene group, a 1,2-diethylbutylene group, 1,3-diethylbutylene group, 1,4-diethylbutylene group, a 1-propylbutylene group, a 2-propylbutylene group, a 1,2-dipropylbutylene group, 1,3-dipropylbutylene group, 1,4-dipropylbutylene group, a 1-butylbutylene group, a 2-butylbutylene group, a 1,2-dibutylbutylene group, 1,3-dibutylbutylene group, 1,4-dibutylbutylene group, a pentylene group, a methyl substituted pentylene group, an ethyl substituted pentylene group, a propyl substituted pentylene group, a butyl substituted pentylene group, a n-hexylylene substituted pentylene group, a n-hepylene substituted pentylene group, and a n-octylene substituted pentylene group.

17. The method of claim 1, wherein $R^3$ is selected from the group consisting of Lorol, iso-$C_{10}$ alcohol, $C_{9/11}$ oxo alcohol, $C_{11/13}$ oxo alcohol, 2-propylheptanol, 2-ethylhexanol benzyl, phenyl, and substituted phenyl.

18. The method as claimed in claim 1, wherein $R^1$ and $R^2$ are both methyl and $R^3$ is a $C_{1-4}$ straight-chain or branched alkyl group or a benzyl group.

19. The detergent and bleach as claimed in claim 4, wherein $R^1$ and $R^2$ are ethyl groups and $R^3$ is a $C_{1-4}$ straight-chain or branched alkyl group or a benzyl group.

* * * * *